US007191976B1

(12) United States Patent
Jensen

(10) Patent No.: US 7,191,976 B1
(45) Date of Patent: Mar. 20, 2007

(54) CABINET FOR STORING AND DISPENSING ROLLS OF PAPER

(76) Inventor: Edward Jensen, 10921 Hutton Dr., Sun City, AZ (US) 85351

( * ) Notice: Subject to any disclaimer, the term of this patent is extended or adjusted under 35 U.S.C. 154(b) by 337 days.

(21) Appl. No.: 10/871,077

(22) Filed: Jun. 18, 2004

(51) Int. Cl.
*B65H 19/00* (2006.01)

(52) U.S. Cl. ..... 242/560.3

(58) Field of Classification Search ..... 242/560.2, 242/560.3; 312/34.22
See application file for complete search history.

(56) References Cited

U.S. PATENT DOCUMENTS

| | | | |
|---|---|---|---|
| 2,605,975 | A | 8/1952 | Page |
| 2,620,991 | A | 12/1952 | Deffenbaugh |
| 2,627,382 | A | 2/1953 | Borton |
| 2,767,930 | A | 10/1956 | McCants |
| 3,580,651 | A | 5/1971 | Gauper |
| 3,865,295 | A | 2/1975 | Okamura |
| 4,108,389 | A | 8/1978 | Womack |
| 4,314,679 | A | 2/1982 | Paul |
| 4,564,148 | A | 1/1986 | Wentworth |
| 5,000,393 | A | 3/1991 | Madsen |
| 5,765,719 | A | 6/1998 | Upham |
| 6,161,794 | A | 12/2000 | Cravatt |
| 6,302,350 | B1 | 10/2001 | Burrell |
| 2001/0028017 | A1 | 10/2001 | Seltzer |
| 2001/0048047 | A1 | 12/2001 | Pafos |

*Primary Examiner*—John Q. Nguyen
(74) *Attorney, Agent, or Firm*—LaValle D. Ptak

(57) ABSTRACT

A cabinet for storing and dispensing rolls of paper includes a housing which has a top, a bottom, a rear and a front side for holding a predetermined number of vertically stacked rolls of paper. A pair of substantially parallel arms extend outwardly from the housing on opposite side of an opening at the bottom for receiving a roll-holding spindle therebetween. An intermediate movable support bar is spaced from the rear of the housing in a first position, and is located above the opening in the bottom of the housing. The support bar is movable to a second position adjacent the rear of the housing against the bias of a spring to cause an angled member to rotate beneath a roll of paper above one supported on the support bar, whereupon the lowermost roll of paper previously supported on the support bar drops to the bottom of the housing for removal from the opening at the bottom.

20 Claims, 5 Drawing Sheets

CABINET FOR STORING AND DISPENSING ROLLS OF PAPER

BACKGROUND

This invention relates to the field of devices designed to store and dispense rolls of paper, such as toilet tissue.

DETAILED DESCRIPTION

Figure 1:
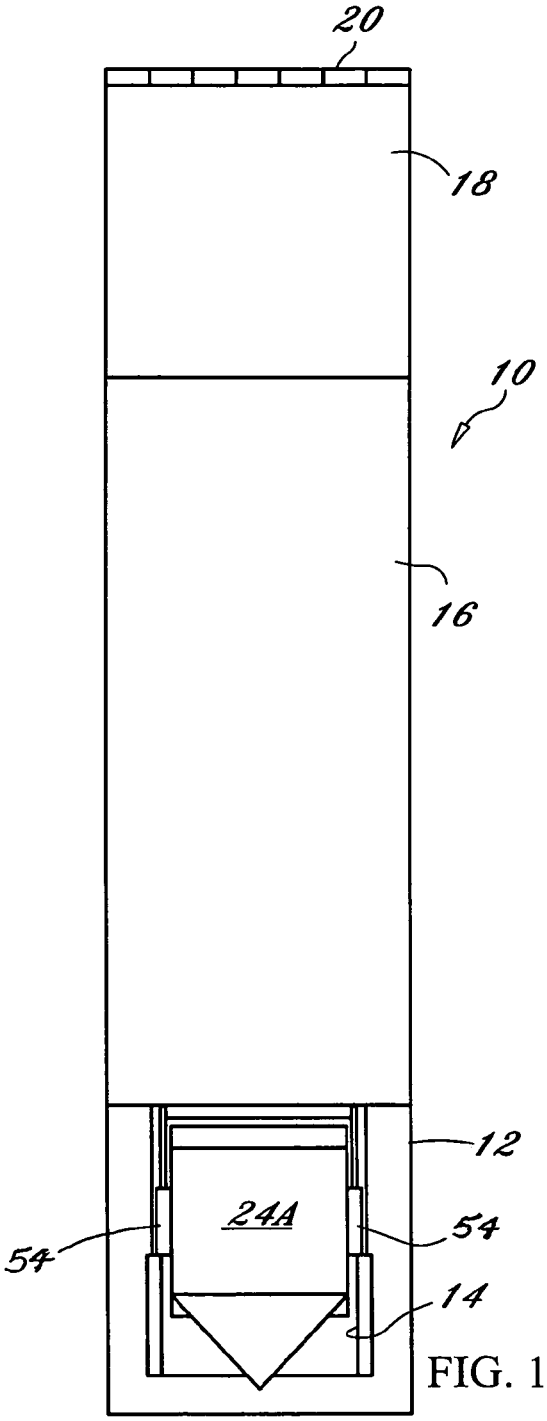
FIG. 1 is a front view of an installation of an embodiment of the invention.

Reference now should be made to the drawings, in which the same reference numbers are used throughout the different figures to designate the same or similar components. The embodiment of the invention which is illustrated is a cabinet 10 designed to be mounted into an opening in the wall of a building, or mounted on the exterior of the wall for storing and dispensing rolls of paper, such as toilet paper. The manner in which the cabinet 10 is placed within an opening in the wall of a room and held in that opening may be by any appropriate means; and consequently, no details of such an installation are shown. In addition, the front of the cabinet has an extending flange around it to cover the space between the cabinet and the opening when it is installed. Such flanges frequently are used in similar installations, such as used for medicine cabinets and the like.

The cabinet 10 itself includes a main housing 12, which is generally in the form of an elongated rectangular box having an open front, a pair of opposite sides, a rear, a top and a bottom. The overall shape of the main housing 12 readily may be ascertained from an examination of FIGS. 1,2,3 and 4. The width of the housing 12 is slightly greater than the width of paper rolls, such as the paper rolls 24A through 24F, which are to be stored in the housing and dispensed therefrom. Similarly, the depth between the back of the housing 12 and the open front is designed to be slightly greater than the thickness of a full roll of paper of the type to be stored within the housing. This is readily ascertained from an examination of FIGS. 2,3 and 4, in particular.

The top of the housing 12 has an opening through the front, which is covered by a door 18 in the closed position, and which is revealed by pivoting the door 18 upwardly on a hinge 20 to expose the uppermost end of the cabinet to allow rolls of paper, such as the rolls 24A through 24F, to be inserted one at a time for storage therein. As shown most clearly in FIGS. 2,3 and 4, the housing of the embodiment shown in these figures is designed to hold and store in reserve five rolls of paper, such as toilet tissue, indicated as the rolls 24B through 24F in the drawings. In addition to the storage of these five rolls, the housing also is designed to present a roll, 24A, in a position of use by extending the roll 24A on a spindle 55 slightly outwardly through an opening at the bottom of the housing 12, again, as shown most clearly in FIGS. 1,2,3 and 4.

Figure 5:
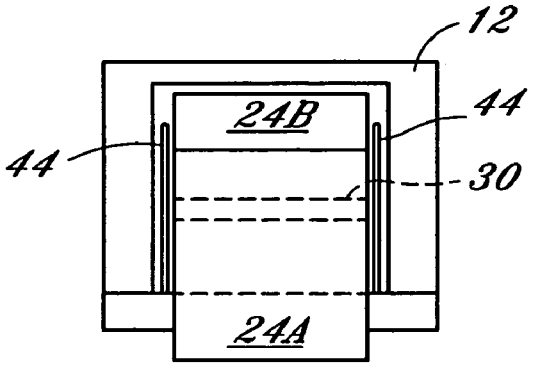
FIG. 5 is a bottom view taken along the line 5—5 of FIG. 4.

A removable front panel 16 is provided for placement over the space between a lower opening 14 in the housing and the bottom of the door 18 over the upper opening in the housing when the door 18 is closed. This panel 16' has a pair of spaced U-shaped arms or rails 44 extending from it on opposite sides, to be located on opposite sides or opposite ends of the rolls 24B to 24E, as shown most clearly in FIGS. 3,4 and 5. The closed ends of the U-shaped arms 44 prevent the opposite ends of the rolls 24B through 24E from engaging the opposite sides of the housing 12, thereby significantly reducing friction between the rolls of paper and the sides of the housing 12 when the rolls of paper drop downwardly through the housing in a manner described subsequently.

Figure 6:
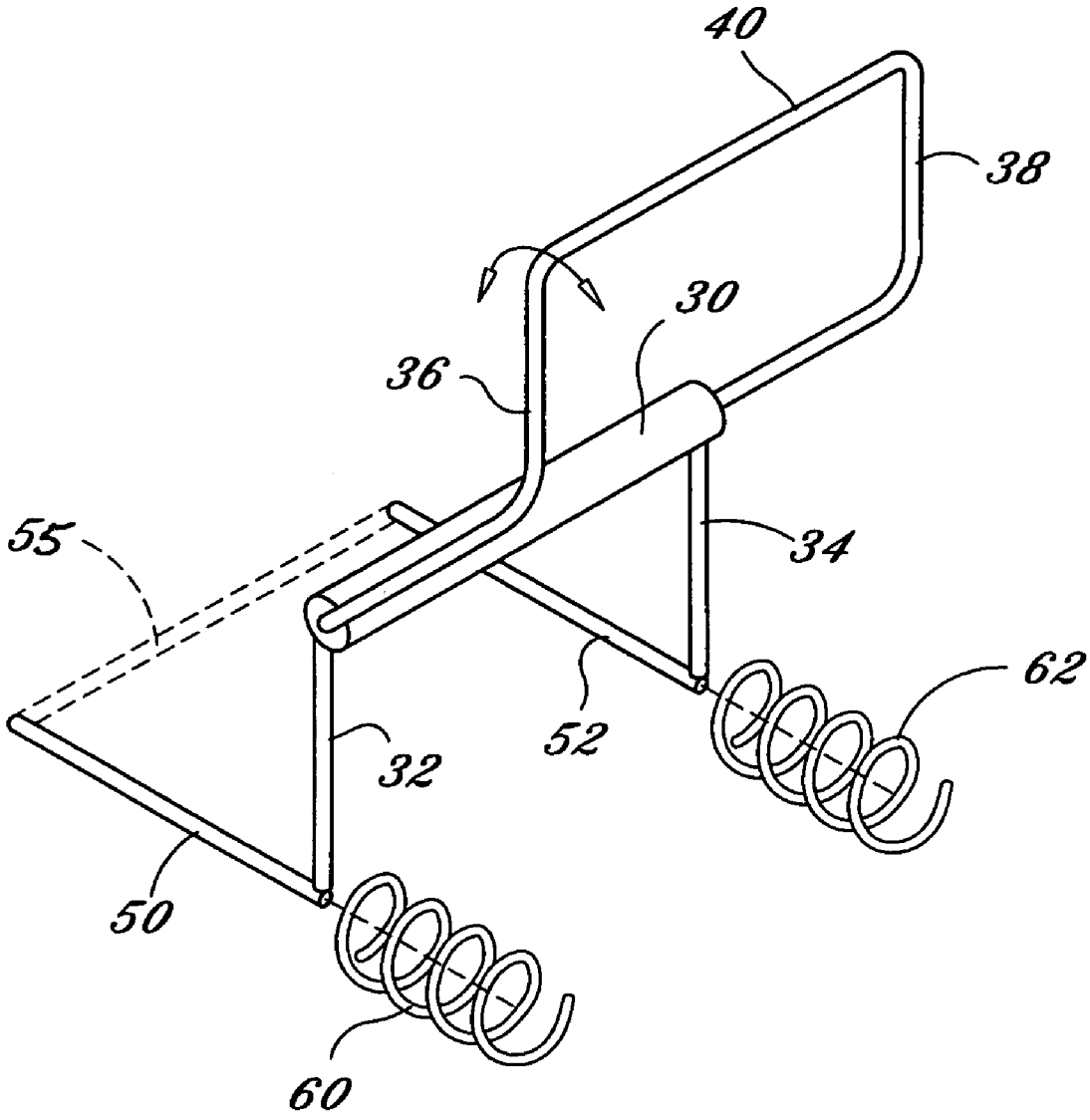
FIG. 6 is an enlarged perspective view of some of the components of the embodiment of FIGS. 1 through 5.

When the housing 12 is used to store and dispense rolls of paper in the form of toilet tissue, the toilet tissue which is currently in use is represented by the roll 24A in the drawings. This roll of tissue is placed on a conventional removable spindle 55, which is diagrammatically represented in FIG. 6, but which may be in the form of any conventional telescoping spindle carried on the ends of a pair of rods or arms 50 and 52, which further are constrained for reciprocal movement in any suitable manner between the rear and the front of the housing 12 in slots 56 formed in support bars 54 located on opposite sides, as shown most clearly in FIGS. 2,3 and 4 of the drawings.

The rods 50 and 52 may be constrained for reciprocal movement by any suitable means, such as projections (not shown) extending outwardly from the rods 50 and 52 into the slots 56. Other configurations may be used as well. Such reciprocating movement may be effected by pushing the spindle 55 from the front of the housing 12 toward the rear against the action of a pair of coil springs 60 and 62, illustrated in FIGS. 6,7 and 8; but this movement also may be effected in a number of different equivalent ways.

Figure 2:
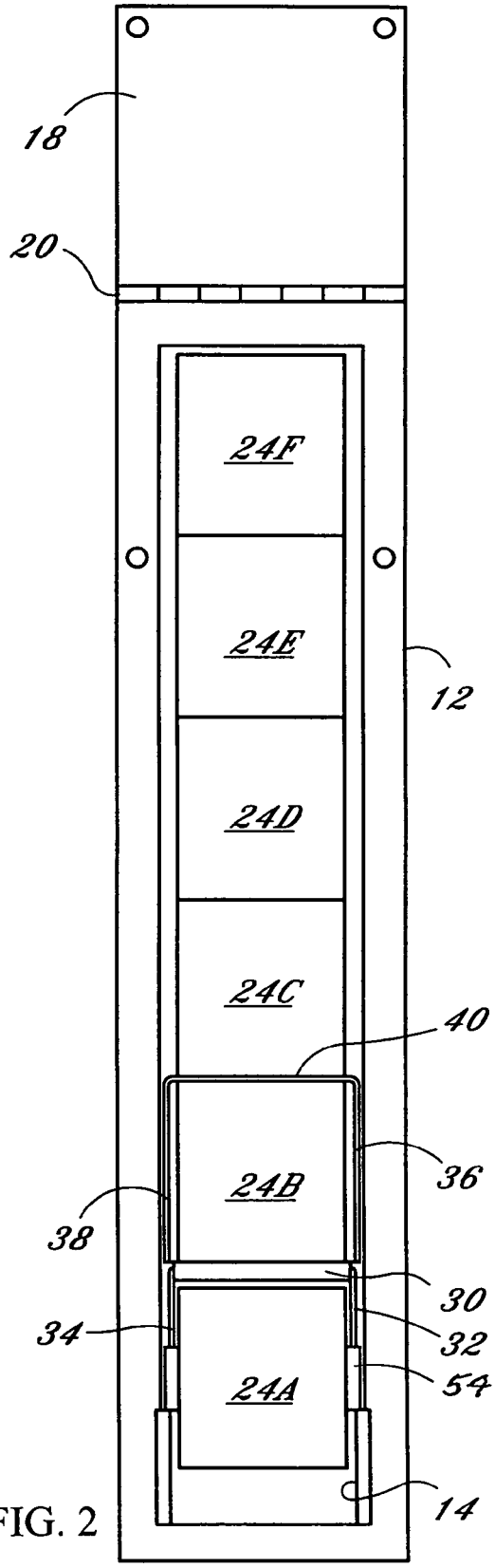
FIG. 2 is a front view of the embodiments shown in FIG. 1 illustrating further details.
Figure 3:
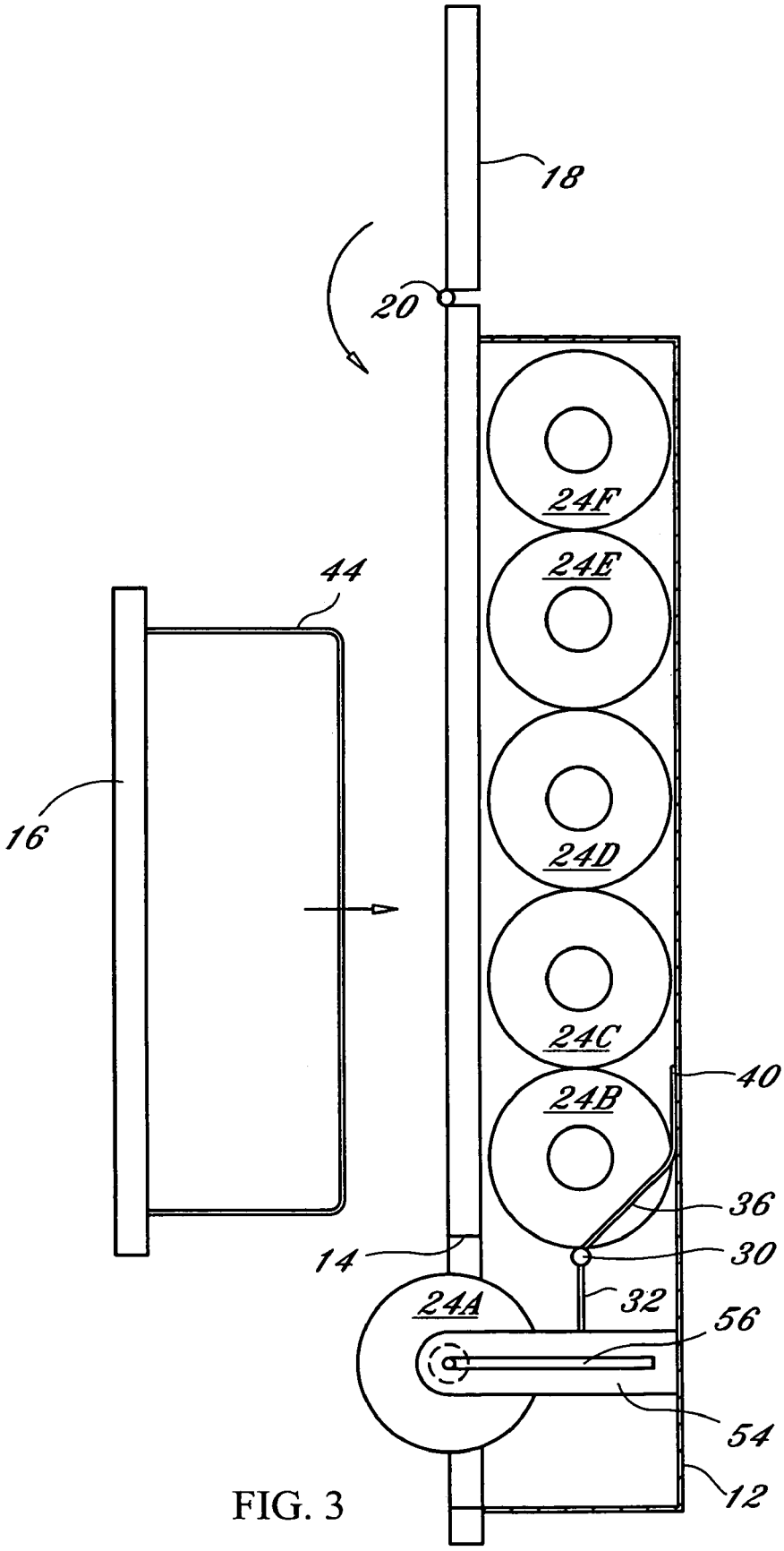
FIG. 3 is a partially exploded cut-away side view of the embodiment shown in FIG. 1.
Figure 4:
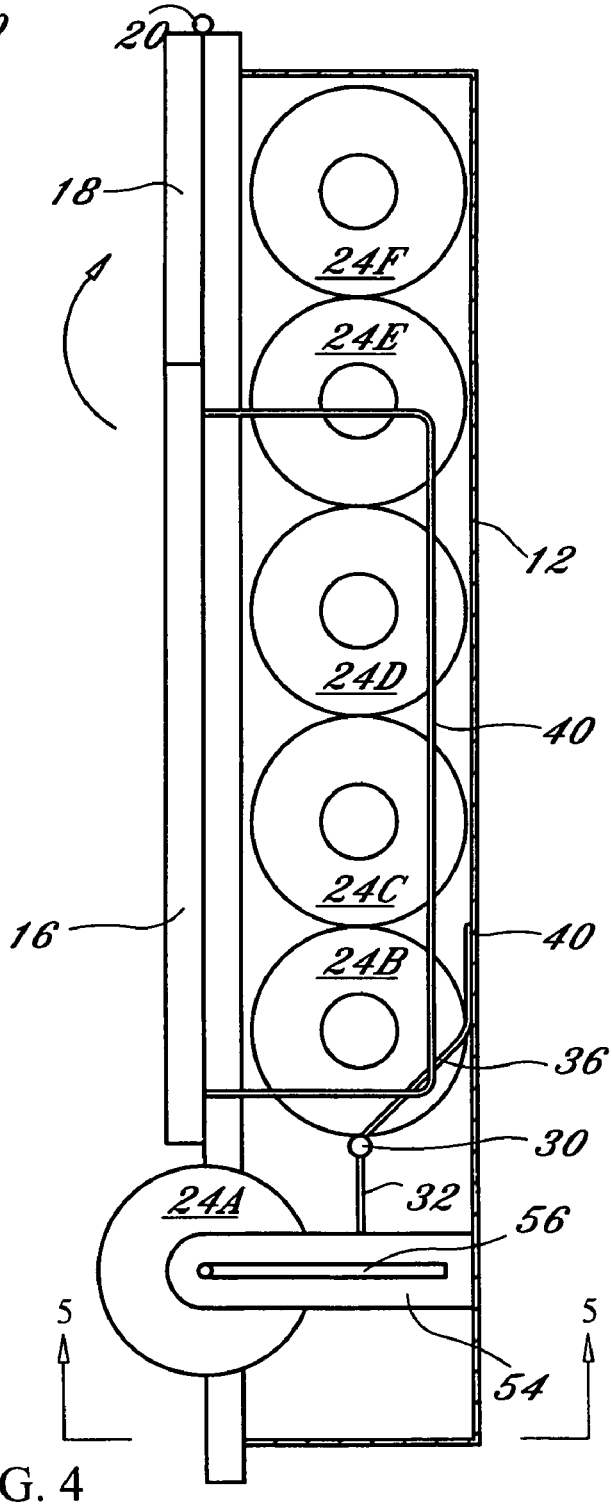
FIG. 4 is an assembled side view of the embodiment shown in FIG. 1.
Figure 7:
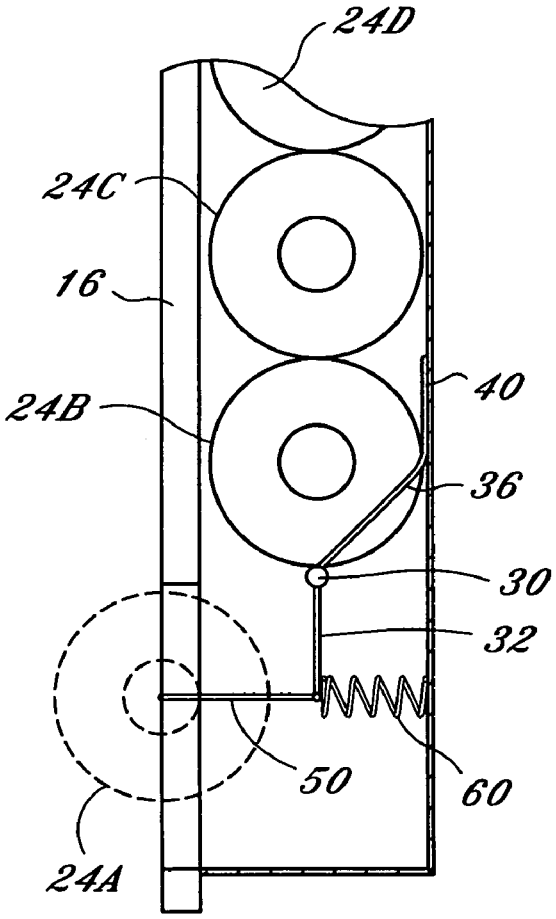
FIG. 7 is a partial cut-away side view of the embodiment shown in FIGS. 3 and 4 in one position of operation.

It should be noted that the coil springs 60 and 62, which are located at the rear of the rods 50 and 52 near or adjacent the connection of these rods to vertical extensions 32 and 34, bias the assembly carrying the spindle 55 outwardly toward the front of the housing 12, as shown in FIG. 7, to allow dispensing of tissue from the roll 24A when it is presented in the position shown in FIGS. 3 and 4. It also should be noted that a rotating roller or support bar 30 extends between the upper ends of the extensions 32 and 34. Normally, in the storage position of the device, this roller or bar 30 is located beneath the roll of paper 24B to support the five rolls above it, as illustrated in FIGS. 2,3 and 4.

When the roll of tissue 24A which currently is in use has been depleted, the paper core upon which this tissue has been wound may be removed from the spindle 55 in a conventional manner. The device then is ready for presentation of the next roll 24B for subsequent mounting in the position of the roll 24A, as shown for that roll in FIGS. 3 and 4.

Figure 8:
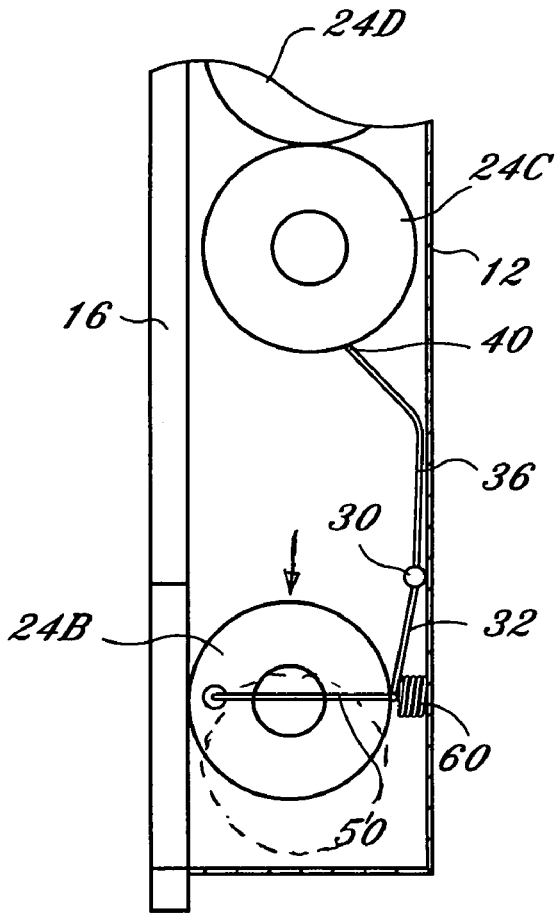
FIG. 8 is a partial cut-away side view of the embodiment shown in FIGS. 3 and 4 in a second position of operation.

To effect this presentation of the next roll, the springs 60 and 62 are depressed toward the right, as shown in FIG. 8, by either pressing on the spindle 55, or in any other suitable manner, to move the rods 50 and 52 toward the rear of the housing 12. This then allows an angled member comprised of the arms 36 and 38 and a cross member 40 to press against the rear of the housing 12 and pivot about the ends of the support bar 30 from the position shown in FIG. 7 to the position shown in FIG. 8. This action also allows the next roll of paper 24B to drop by gravity to the bottom of the housing 12, since the support bar 30 is moved from the position shown in FIG. 7 to the position shown in FIG. 8, allowing this drop to occur. Simultaneously, however, the end 40 of the angled member 36/38/40 moves from the position shown in FIG. 7 (the normal storage position) to the position shown in FIG. 8 underlying and holding the next roll 24C, to prevent any droppage of the rolls 24C through 24F when the roll 24B first is dropped to the position shown in FIG. 8.

Once the roll 24B has been dropped to the position shown in FIG. 8, it then can be removed outwardly through the front opening in the housing (first removing the spindle 55), whereupon the springs 60 and 62 return the mechanism to the position shown in FIG. 7. When this occurs, the next roll 24C drops to the position shown by the roll 24B in FIG. 7; and all of the remaining rolls above the roll 24C drop to one position lower than the one shown in the drawings of FIGS. 2,3 and 4.

When the new roll 24B has been depleted, the operation just described above for removal of the core for the roll 24A also is effected for the roll 24B; and the entire process is repeated to present the new roll 24C for removal and presentation in the delivery position. At any time, addition of one or more rolls of paper through the door 18 over the opening in the top of the housing 12 may be effected to maintain storage of paper rolls within the cabinet. Clearly, however, replacement does not have to be effected on a one-for-one basis, that is, each time a roll is used up. Rather, several rolls of paper may be delivered, used and depleted in the manner described above before restocking the cabinet with five of less rolls for subsequent dispensing and utilization.

The foregoing description of the embodiment of the invention shown in FIGS. 1 through 8 is to be considered as illustrative and not as limiting. For example, the coil springs 60 and 62 may be replaced with other types of springs, solenoids or equivalent mechanisms. Various other changes and modifications will occur to those skilled in the art for performing substantially the same function, in substantially the same way, to achieve substantially the same result without departing from the true scope of the invention as defined in the appended claims.

What is claimed is:

1. A cabinet for storing and dispensing rolls of paper including in combination: a housing having a top, a bottom, opposite sides, a rear and a front for holding a predetermined number of vertically stacked rolls of paper, with an opening at the top of the housing for receiving rolls of paper to be stored in the housing, and an opening at the bottom of the housing for removing rolls of paper from the housing; a pair of substantially parallel arms extending outwardly from the housing, on opposite sides of the opening at the bottom of the housing, for receiving a roll-holding spindle therebetween; an intermediate movable, rotatable support bar in a first position extending substantially across, and spaced from the rear of, the housing above the opening at the bottom of the housing, the support bar being located beneath a lowermost roll of paper stored in the housing; an angled member pivotally attached to the ends of the intermediate movable support bar; a spring normally biasing the support bar to the first position; means for moving the support bar to a second position adjacent the rear of the housing against the bias of the spring, causing the angled member to rotate beneath and hold a roll of paper above a roll supported on the support bar allowing the lowermost roll of paper previously resting on the support bar to drop by gravity to the bottom of the housing for the housing, thereafter allowing the spring to bias the support bar back to the first position and the angled member to return to a position adjacent the rear of the housing.

2. A cabinet according to claim 1 further including guide rails in the housing on opposite sides of the rolls of paper.

3. A cabinet according to claim 2 wherein the angled member is a generally L-shaped member located adjacent the rear of the housing in the first position thereof, and which is located at a position intermediate the front and rear of the housing in the second position of the support bar.

4. A cabinet according to claim 3 wherein the spindle is a removable spindle.

5. A cabinet according to claim 4 wherein the spring comprises a compression coil spring.

6. A cabinet according to claim 5 wherein the spring comprises a pair of compression coil springs located substantially at opposite ends of the support bar.

7. A cabinet according to claim 6 wherein the angled member is pivotally attached to the ends of the support bar to pivot from a first position to a second position, and back to the first position as the support bar is reciprocated from the first position thereof to the second position thereof, and back to the first position thereof.

8. A cabinet according to claim 7 wherein a roll of paper on the spindle is biased by the spring to a position extending through the opening at the bottom of the housing beyond the front of the housing.

9. A cabinet according to claim 8 wherein the opening at the top of the housing is in the front of the housing and further including a removable cover for the opening at the top of the housing.

10. A cabinet according to claim 9 wherein the angled member includes first and second substantially identical lever arms each pivotally attached at one end to opposite ends of the intermediate support bar with the other ends of the lever arms interconnected by a portion extending substantially parallel to the support bar.

11. A cabinet according to claim 10 wherein the predetermined number of vertically stacked rolls of paper is at least two.

12. A cabinet according to claim 1 wherein the front of the housing between the opening at the top of the housing and the opening at the bottom of the housing is closed by a removable panel having guide rails extending therefrom on opposite sides of rolls of paper stored in the housing to space the rolls of paper from the sides of the housing to reduce friction between the housing and rolls of paper stored therein.

13. A cabinet according to claim 12 wherein the opening at the top of the housing is in the front of the housing and further including a removable cover for the opening at the top of the housing.

14. A cabinet according to claim 1 wherein the angled member includes first and second substantially identical lever arms each pivotally attached at one end to opposite ends of the intermediate support bar with the other ends of the lever arms interconnected by a portion extending substantially parallel to the support bar.

15. A cabinet according to claim 14 wherein the angled member is pivotally attached to the ends of the support bar to pivot from a first position to a second position, and back to the first position as the support bar is reciprocated from the first position thereof to the second position thereof, and back to the first position thereof.

16. A cabinet according to claim 1 wherein the angled member is pivotally attached to the ends of the support bar to pivot from a first position to a second position, and back to the first position as the support bar is reciprocated from the first position thereof to the second position thereof, and back to the first position thereof.

17. A cabinet according to claim 1 wherein the spring comprises a compression coil spring.

18. A cabinet according to claim 17 wherein the spring comprises a pair of compression coil springs located substantially at opposite ends of the support bar.

19. A cabinet according to claim 1 wherein the spindle is a removable spindle.

20. A cabinet for storing and dispensing rolls of paper including in combination: a housing having a top, a bottom, opposite sides, a rear and a front for holding a predetermined number of vertically stacked rolls of paper, with an opening at the top of the housing for receiving rolls of paper to be stored in the housing, and an opening at the bottom of the housing for removing rolls of paper from the housing; a pair of substantially parallel arms extending outwardly from the housing, on opposite sides of the opening at the bottom of the housing, for receiving a roll-holding spindle therebetween; an intermediate movable support bar in a first position extending substantially across, and spaced from the rear of, the housing above the opening at the bottom of the housing, the support bar being located beneath a lowermost roll of paper stored in the housing; an L-shaped angled member pivotally attached to the ends of the intermediate movable support bar, the angled member being located adjacent the rear of the housing in the first position of the support bar and located at a position intermediate the front and rear of the housing in the second position of the support bar; a pair of compression coil springs located substantially at opposite ends of the support bar normally biasing the support bar to the first position; means for moving the support bar to a second position adjacent the rear of the housing against the bias of the springs, causing the angled member to rotate beneath and hold a roll of paper above a roll supported on the support bar allowing the lowermost roll of paper previously resting on the support bar to drop by gravity to the bottom of the housing for removal from the opening at the bottom of the housing, thereafter allowing the springs to bias the support bar back to the first position and the angled member to return to a position adjacent the rear of the housing wherein a roll of paper on the spindle is biased by the springs to a position extending through the opening a the bottom of the housing beyond the front of the housing.

* * * * *